US012599251B2

(12) United States Patent
Goppion

(10) Patent No.: US 12,599,251 B2
(45) Date of Patent: Apr. 14, 2026

(54) DISPLAY CASE WITH REMOVABLE AND LIFTABLE TRAY FOR HYGROSCOPIC MATERIAL

(71) Applicant: GOPPION S.P.A., Trezzano sul Naviglio (IT)

(72) Inventor: Alessandro Goppion, Milan (IT)

(73) Assignee: GOPPION S.P.A., Trezzano sul Naviglio (IT)

( * ) Notice: Subject to any disclaimer, the term of this patent is extended or adjusted under 35 U.S.C. 154(b) by 65 days.

(21) Appl. No.: 18/586,928

(22) Filed: Feb. 26, 2024

(65) Prior Publication Data

US 2024/0285097 A1 Aug. 29, 2024

(30) Foreign Application Priority Data

Feb. 27, 2023 (IT) ..... 102023000003408

(51) Int. Cl.
*A47F 3/06* (2006.01)
*A47F 3/00* (2006.01)

(52) U.S. Cl.
CPC ..... *A47F 3/063* (2013.01); *A47F 3/001* (2013.01)

(58) Field of Classification Search
CPC .. A47F 3/001; A47F 3/005; A47F 3/06; A47F 3/063; A47B 88/00; A47B 88/433; A47B 88/44; A47B 88/48; A47B 88/49; A47B 88/60; A47B 46/00; A47B 51/00; A47B 87/00; E05D 3/00; E05D 3/02; E05D 3/14; E05D 15/46; E05D 15/56
USPC ..... 312/31, 114, 122, 246, 247, 298, 323, 312/325, 332, 334.2, 334.29, 334.13; 108/70, 71, 72, 73
See application file for complete search history.

(56) References Cited

U.S. PATENT DOCUMENTS

| | | | | |
|---|---|---|---|---|
| 5,127,718 A | | 7/1992 | Paine et al. | |
| 5,302,015 A | * | 4/1994 | Du Vall | A47B 21/0314 312/282 |
| 7,527,342 B2 | * | 5/2009 | Lemm | A47B 88/467 312/331 |
| 2019/0090659 A1 | * | 3/2019 | Fixler | A47F 3/001 |

FOREIGN PATENT DOCUMENTS

| | | |
|---|---|---|
| CN | 203059075 U | 7/2013 |
| CN | 109588913 B | 9/2020 |

OTHER PUBLICATIONS

Italian Search Report issued for Italian Application No. 102023000003408 filed on Feb. 27, 2023 on behalf of Goppion S.P.A. Completion Date: Aug. 31, 2023. 2 Pages.

* cited by examiner

*Primary Examiner* — Daniel J Troy
*Assistant Examiner* — Elizabeth Irene Artalejo
(74) *Attorney, Agent, or Firm* — Steinfl + Bruno LLP

(57) ABSTRACT

A museum display case with climate control comprises a case bottom, a display space above the case bottom, a shelf inside the display space, and a housing for hygroscopic material facing into the display space below the shelf. The housing includes a housing window open in the case bottom, a housing frame fixed to the case bottom below the housing window, and a tray mounted in the housing frame. The tray is horizontally and vertically movable between a working position where the tray is raised vertically towards the display space at the window and a service position where the tray is at least partly pulled horizontally out of the housing frame.

8 Claims, 4 Drawing Sheets

DISPLAY CASE WITH REMOVABLE AND LIFTABLE TRAY FOR HYGROSCOPIC MATERIAL

CROSS REFERENCE TO RELATED APPLICATIONS

The present application claims priority to Italian patent application No. 102023000003408 filed on Feb. 27, 2023, the contents of which are incorporated herein by reference in their entirety.

FIELD

The present application relates to a museum display case for preserving and displaying objects in a protected environment, such as typically artworks, objects of cultural heritage or in any case delicate objects, in museums, exhibitions and the like.

BACKGROUND

Protected environment means herein and below an environment in which the atmosphere is controlled, by monitoring one or more parameters among temperature, relative humidity, dust content, and pollutant content, in order to maintain the required preservation conditions of the displayed objects, and in which the possibility of access to unauthorized personnel is prevented, to avoid theft or damage to the displayed objects.

This type of display case must therefore meet various requirements, in relation to conservation and integrity of the displayed objects. Furthermore, obviously, these display cases must guarantee the best visibility for the objects on display so as to allow those who manage museums and exhibitions to organize adequate exhibition itineraries, depending on the cultural message they want to convey.

SUMMARY

In museum display cases with climate control, a hygroscopic material, typically silica gel, is often used to keep the humidity level within the display space of the display case under control. This control system, also called passive control, is simpler and cheaper than an active control system, with a refrigeration cycle thermal system, and in many situations is more than enough to guarantee the climate conditions required by the displayed objects. Furthermore, in the presence of an active control system, a passive control system is also often provided, both to cope with possible interruptions in the operation of the active control system (for example due to unforeseen power supply failures) and to make the task of the active control system less burdensome.

When a passive control system is used, either alone or in combination with an active control system, it is necessary to replace the hygroscopic material when it is exhausted, as having absorbed all the humidity it can absorb. This operation must be done simply and safely, and above all avoiding that removing exhausted material and inserting new one creates conditions detrimental to the integrity of the objects contained in the display case.

Therefore, the hygroscopic material is normally placed in one or more trays, which are placed within the display space. Often these trays are placed so as to be hidden from view, not to disturb the enjoyment of the displayed objects; in this case, they are placed in spaces that are formed in the base of the display case, but which are in any case communicating with the display space from which they must absorb humidity. However, such a location can make the system less effective, due to the increased difficulty in air circulation.

The object of the present application is to make available a museum display case with a passive climate control system that overcomes the aforementioned drawbacks.

Accordingly, the present application relates to a museum display case according to the claims.

More specifically, the present application relates to a climate-controlled museum display case, comprising:

- a bottom,
- a display space above the bottom,
- a shelf, inside the display space,
- a housing for hygroscopic material, facing into the display space below the shelf, characterised in that the housing for hygroscopic material comprises:
  - a window open in the bottom,
  - a frame, fixed to the bottom below the window,
  - a tray, movably mounted in the frame both horizontally and vertically, between a working position in which it is raised vertically towards the display space at the window and a service position in which it is at least partly pulled horizontally out of the frame.

Thanks to this display case architecture, during normal use the hygroscopic material is located in the working position, in an area within the display space that is raised relative to the bottom of the display case; this position allows optimal contact with the air inside the display space and thus guarantees an effective humidity control action. In addition, in the service position of the tray, access to the hygroscopic material is eased by the removal of the tray from the frame; replacement of the hygroscopic material is therefore quick and easy and implies no risks to the objects displayed in the display case.

Preferably, the housing for hygroscopic material comprises a slide, movably mounted horizontally on the frame, wherein the tray is mounted on the slide by means of four identical and parallel connecting rods, each connecting rod being pivoted at one end to the slide and at a second end to the tray.

The slide makes it possible to guide the tray horizontally out of the frame, so as to operate on the hygroscopic material, e.g. to replace it. Thanks to the connecting rods, then, the tray is movable relative to the slide in a vertical direction, always remaining in a horizontal position.

Preferably, the tray comprises at least one feeler, slidably engaged along a respective ramp as the tray approaches the working position. More preferably, there are two feelers and two ramps.

When the slide is moved horizontally within the frame, the tray remains in a relatively lowered position until each feeler meets the ramp; at that point, if the slide continues to be moved horizontally, the feelers engaged with the ramps cause the tray to lift vertically relative to the slide, allowing the tray to advance towards the window so that the hygroscopic material contained therein is arranged within the display space.

Preferably, the tray—when in the working position—is in contact with the bottom and closes the window, thereby closing the display space with the hygroscopic material inside the tray.

This way of closing the window, through which the hygroscopic material in the tray enters and leaves the display space of the display case, is particularly simple and effective. In fact, closing and opening are automatic and direct as a result of the movement of the slide carrying the tray.

Preferably, the housing for hygroscopic material comprises a perimeter flange of the tray and a gasket between the perimeter flange and the bottom. This gasket can be placed either on the perimeter flange of the tray or on the bottom, around the window, and ensures the air-tightness of the closure due to the fact that the upward movement of the tray causes a compression of the gasket between the flange and the bottom.

Preferably, the housing for hygroscopic material comprises a rack on the slide and a pinion mounted on the frame, in mesh engagement with the rack. In this way, it is possible to actuate the horizontal movement of the slide by means of the pinion and—by means of this—the horizontal and vertical movement of the tray. The pinion can be actuated in various ways, e.g. by an electric motor or by means of a crank, external to the display case.

DESCRIPTION OF THE DRAWINGS

Further characteristics and advantages of the disclosure will be more evident from the following description of a preferred embodiment thereof, made with reference to the appended drawings. In such drawings.

DETAILED DESCRIPTION

Figure 1:
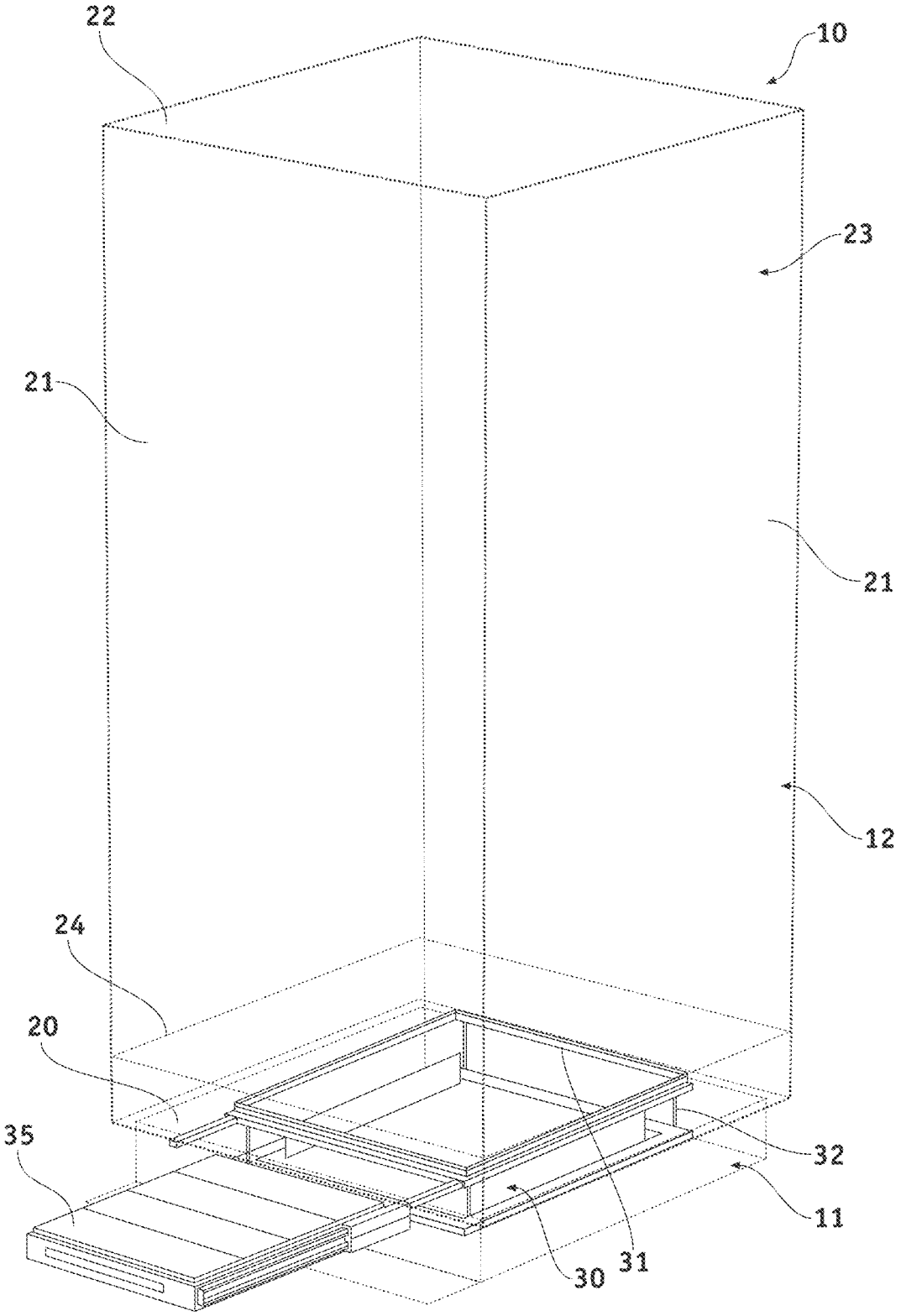
FIG. 1 is a schematic and simplified perspective view of a display case according to the present application.

A museum display case 10, which comprises a base 11 surmounted by a case 12 for displaying objects is shown in the figures. The case 12 comprises a load-bearing case bottom 20, on which side walls 21 are mounted, which in turn are surmounted by a ceiling 22; between the case bottom 20, the walls 21 and the ceiling 22 a sealed display space 23 is defined. The case 12 can be opened to allow access to the display space 23; there are different ways of opening it, for example the walls 21 and the ceiling 22 can form a liftable single-piece assembly, or one or more of the walls 21 or the ceiling 22 can be opened. In the figures, no opening system is shown, as it is in any case unrelated to the present application.

In the lower part of the display area 23, a shelf 24 is provided on which the objects displayed in the display case 10 can be placed. The shelf 24 is fixed to the case bottom 20, raised relative thereto and spaced apart from the walls 21, so that there is a passage of air and so that the sealed display space 23 also extends below the shelf 24.

Below the case bottom 20, the display case comprises a housing for hygroscopic material, globally denoted by 30, facing into the display space 23 below the shelf 24.

The housing 30 comprises a housing window 31, formed in the case bottom 20 and extending over most of the surface of the case bottom 20, and a housing frame 32, fixed to the case bottom 20 below the housing window 31.

A slide 33 is mounted in the housing frame 32, movably guided in the housing frame 32 horizontally. A tray 34 is mounted on the slide 33, to accommodate hygroscopic material 35, such as silica gel pellets; the tray 34 is mounted on the slide 33 by means of an articulated parallelogram system, formed by four equal and parallel connecting rods 36. Each connecting rod 36 is pivoted at a first end thereof to the slide 33 and at a second end thereof to the tray 34; the pivot axes of the four connecting rods 36 are horizontal and parallel to each other, perpendicular to the sliding direction of the slide 33 in the housing frame 32.

Thus, the tray 34 is movable in the housing frame 32 both horizontally, together with the slide 33, and vertically, rising relative to the slide 33 as guided by the connecting rods 36. The tray 34 is thus capable of assuming either a working position in which it is raised vertically towards the display space 23, with the hygroscopic material 35 facing through the housing window 31, or a service position in which it is lowered onto the slide 33 and is pulled horizontally out of the housing frame 32 together with the slide 33.

Figure 2:
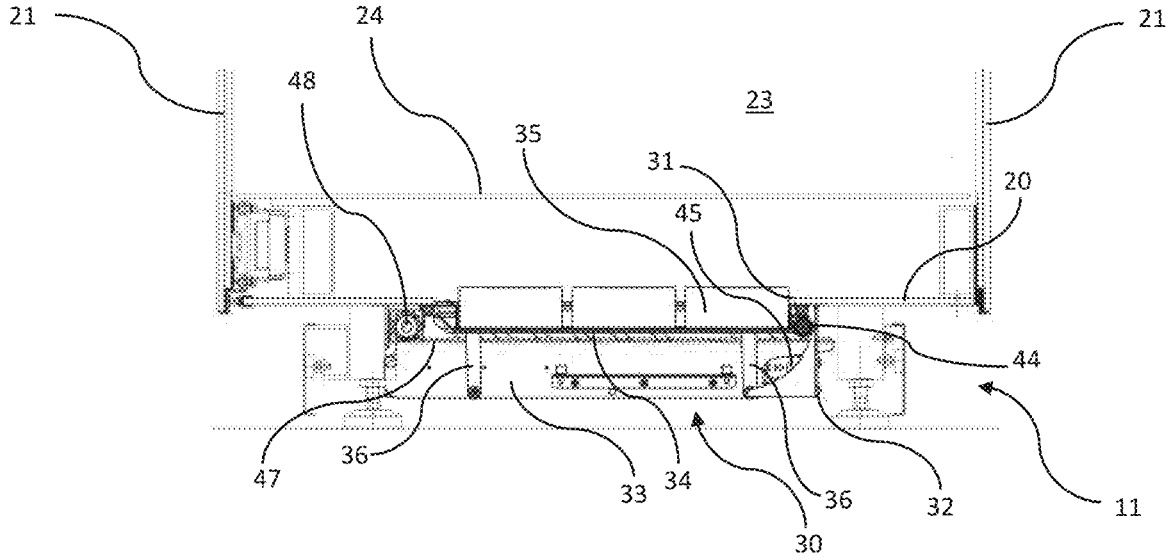
FIG. 2 is a partial vertical section view of the lower zone of the display case of FIG. 1, with the tray in a working position.
Figure 4:
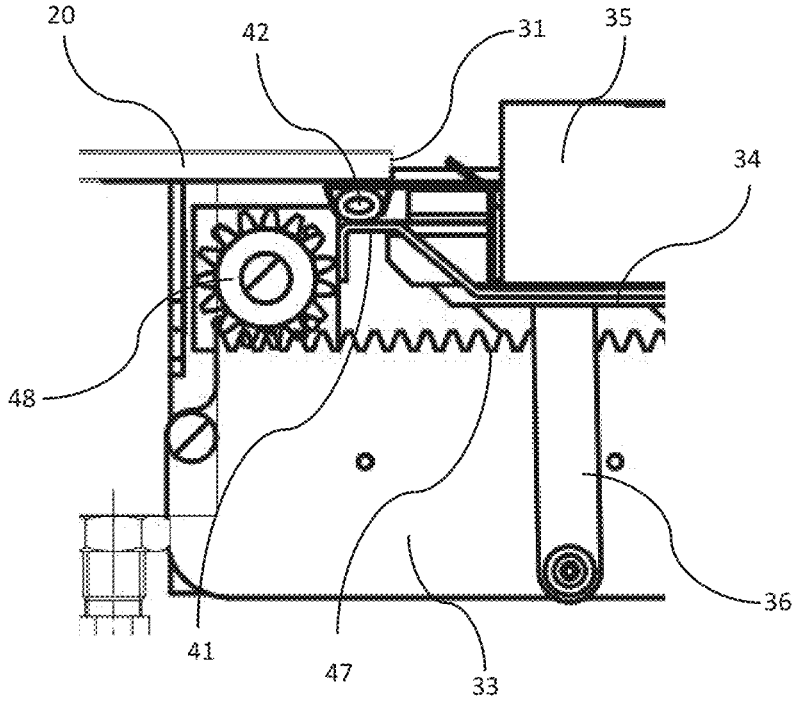
FIG. 4 is an enlargement of a detail of the display case of FIG. 2.
Figure 5:
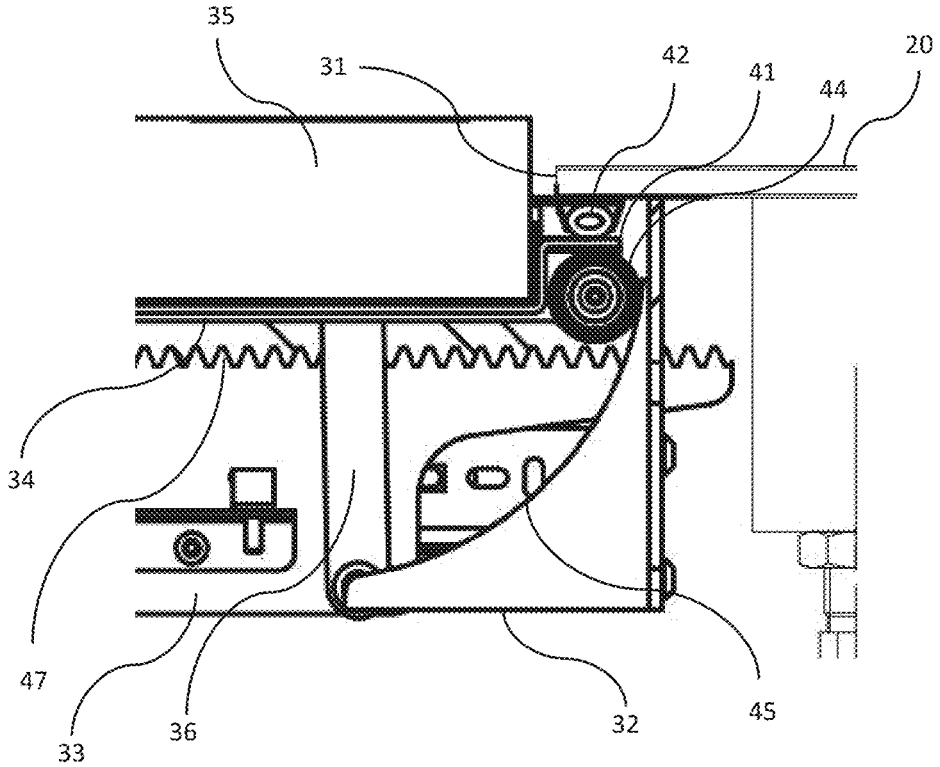
FIG. 5 is an enlargement of another detail of the display case of FIG. 2.
Figure 6:
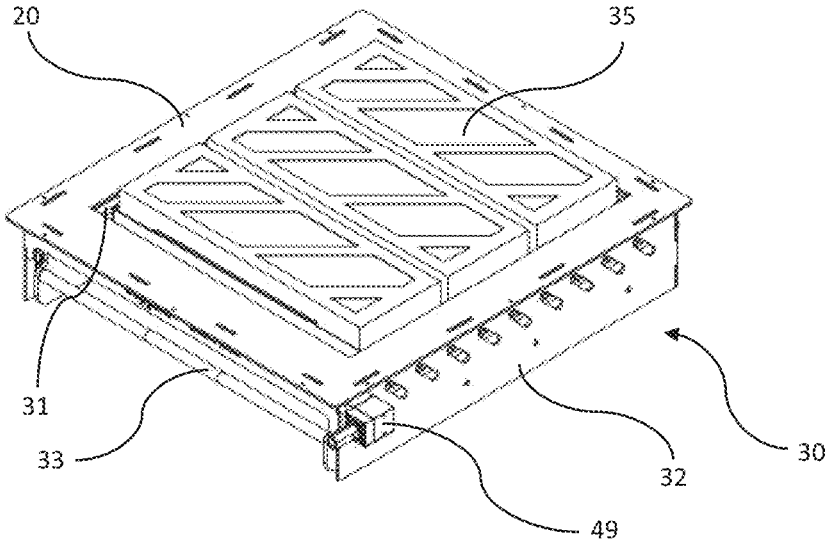
FIG. 6 is a perspective view of the housing for the hygroscopic material of the display case of FIG. 1, with the tray in the working position.

The tray 34 comprises a perimeter flange 41 and consists of a continuous plane, e.g. of sheet metal, without holes, slots or passages, so that when it is in the working position it is able to close the housing window 31. In this position (visible in FIGS. 2, 4 and 5), the hygroscopic material 35 on the tray 34 is closed inside the display space 23, in contact with the atmosphere present therein. To ensure an air-tight sealing, a gasket 42, e.g. of the O-ring type, is provided, fixed below the case bottom 20, around the housing window 31. When the tray 34 is in the working position, the gasket 42 is compressed between the case bottom 20 and the flange 41 of the tray 34.

The tray 34 is then provided with two feelers 44, preferably consisting of respective rotatable rollers. Correspondingly, the housing frame 32 is provided with two respective ramps 45, formed on the housing frame 32 or fixed integral with it, which are engaged by the feelers 44 during the passage of the tray 34 from the working position to the service position, as described below.

The slide 33 is provided with at least one rack 47, which is in mesh engagement with a respective pinion 48, rotatably mounted on the housing frame 32; the pinion 48 can be actuated in rotation by an angular transmission element 49, for example by an electric motor (not shown) or by a crank (not shown) that is external to the display case 10. In the display case 10 of the example shown, they are provided two racks 47 and two respective pinions 48, coaxial and integral with each other in rotation; each rack 47 is in mesh engagement with one of the respective pinions 48.

The operation of the display case 10 is clear from the above description and will now be shown with reference to the figures.

Normally, the tray 34 is in its working position (visible in FIGS. 2, 4, 5 and 6). The hygroscopic material 35 is thus facing into the display space 23, in contact with the atmosphere contained in the display space itself; the hygroscopic material 35 can thus perform its action of controlling the relative humidity present in the display space 23. The housing window 31 is closed by the tray 34, sealed by the engagement of the flange 41, which presses the gasket 42 against the case bottom 20 from below; the display space 23 is thus air-tightly sealed and the action of the hygroscopic material is not dispersed outside.

Figure 3:
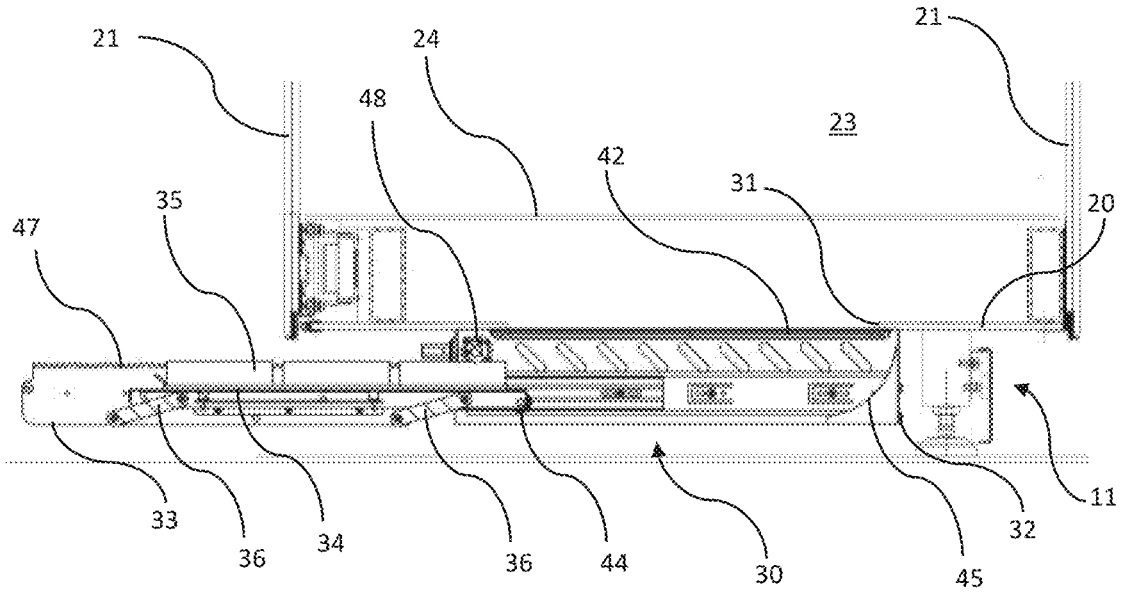
FIG. 3 is a partial vertical section view of the lower zone of the display case of FIG. 1, with the tray in the service position.
Figure 7:
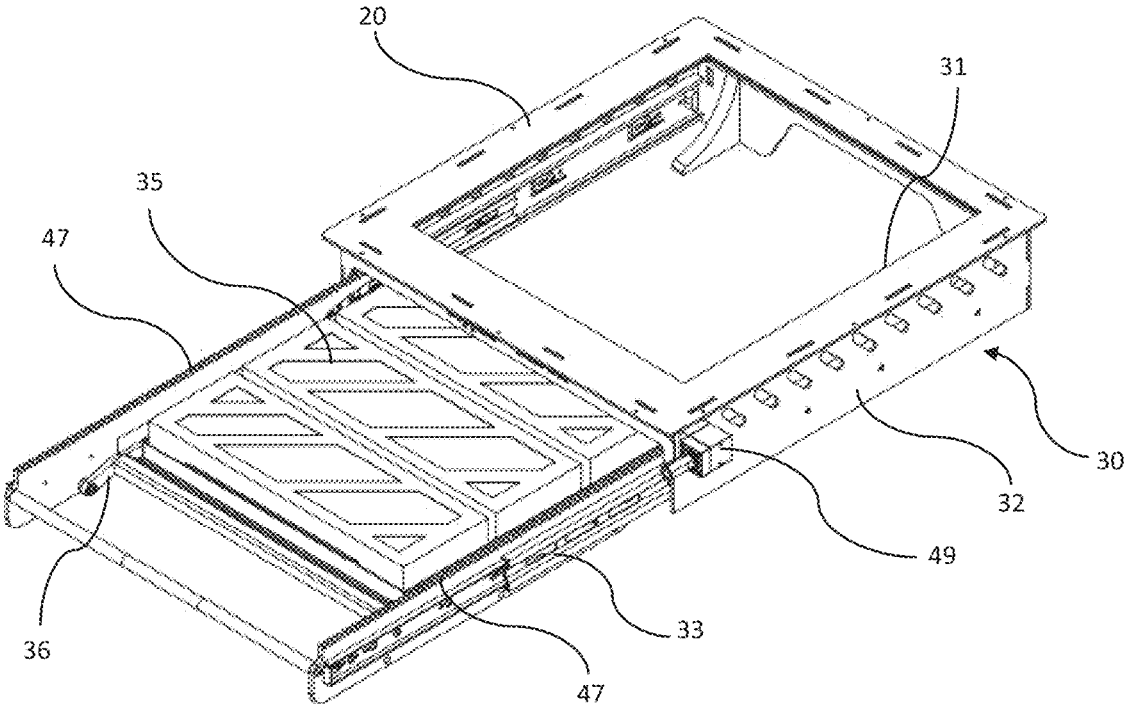
FIG. 7 is a perspective view of the housing for the hygroscopic material of the display case of FIG. 1, with the tray in the service position.

When the hygroscopic material 35 is to be removed and/or loaded, the tray 34 is moved to its service position (visible in FIGS. 1, 3 and 7). To this end, the pinions 48, which act on the racks 47, are driven, causing the slide 33 to move horizontally relative to the housing frame 32, in particular, to the left in the aforesaid figures. When the slide 33 begins its horizontal movement to the left relative to the housing frame 32, the tray 34 carried by the slide 33 begins to descend vertically downwards, pushed by its own weight, while the two feelers 44 follow their respective ramps 45. The vertical movement of the tray 34 on the slide 33 is guided by connecting rods 36, which ensure that the tray 34 remains horizontal. Once the feelers 44 have run throughout the extension of their respective ramps 45, the tray 34 simply rests on the slide 33 and continues together with the slide 33 to move horizontally to the left, until it reaches its service position, at least partially pulled horizontally out of the housing frame 32 relative to the housing 30. With the tray 34 in this position, it is possible to easily act on the hygroscopic material 35 to replace it, supplement it or even just check its condition.

Once the intervention on the hygroscopic material 35 has been completed, the tray 34 can be quickly returned from its service position to its working position, thus minimising the time during which the atmosphere inside the display space is open to the outside through the housing window 31. To do this, the pinions 48 acting on the racks 47 are actuated in the opposite direction than done before, causing the slide 33 to move horizontally relative to the housing frame 32, particularly to the right. Firstly, the tray 34 rests on the slide 33 until the feelers 44 meet the respective ramps 45. At that point, while the movement of the slide 33 continues horizontally to the right, the ramps 45 force the feelers 44 to move upwards and with them the entire tray 34 is moved upwards until it reaches the working position.

As explained, with this display case 10 the hygroscopic material 35 faces directly into the display space 23, raised relative to the case bottom 20, when the tray 34 is in its working position. This position cases the humidity-absorbing action and thus the efficiency of the hygroscopic material 35. In addition, any intervention on the hygroscopic material 35 can be carried out quickly and easily, reducing the time during which the atmosphere inside the display space 23 is not protected by the hygroscopic material.

The invention claimed is:

1. A museum display case with climate control, comprising:

a case bottom, a display space above the case bottom, a shelf inside the display space, a housing for hygroscopic material, facing into the display space below the shelf, the housing comprising:

a housing window open in the case bottom, a housing frame, fixed to the case bottom below the housing window, and a tray, mounted in the housing frame, the tray being horizontally and vertically movable between a working position wherein the tray is raised vertically towards the display space at the housing window and a service position wherein the tray is at least in part pulled horizontally out of the housing frame, wherein the housing comprises a perimeter flange of the tray and a gasket between the perimeter flange and the case bottom, and wherein, in the working position, the gasket is compressed between the case bottom and the perimeter flange providing an air-tight sealing.

2. The museum display case according to claim 1, wherein the housing comprises a horizontally movable slide mounted on the housing frame, and the tray is mounted on the slide by connecting rods, each connecting rod being pivoted to the slide at a first rod end and being pivoted to the tray at a second rod end.

3. The museum display case according to claim, 2, wherein the connecting rods are identical and parallel connecting rods.

4. The museum display case according to the claim 3, wherein the identical and parallel connecting rods are four identical and parallel connecting rods.

5. The museum display case according to claim 2, wherein the tray comprises at least one feeler in sliding engagement along a ramp when the tray approaches the working position.

6. The museum display case according to claim 1, wherein, in the working position, the tray is in contact with the case bottom and closes the housing window, thereby closing the display space.

7. The museum display case according to claim 2, wherein the housing comprises a rack on the slide and a pinion mounted on the housing frame, the pinion being in mesh engagement with the rack.

8. A museum display case with climate control, comprising:

a case bottom, a display space above the case bottom, a shelf inside the display space, a housing for hygroscopic material, facing into the display space below the shelf, the housing comprising:

a housing window open in the case bottom, a housing frame, fixed to the case bottom below the housing window, and a tray, mounted in the housing frame, the tray being horizontally and vertically movable between a working position wherein the tray is raised vertically towards the display space at the housing window and a service position wherein the tray is at least in part pulled horizontally out of the housing frame, wherein the housing comprises a horizontally movable slide mounted on the housing frame, and the tray is mounted on the slide by four identical and parallel connecting rods, each connecting rod being pivoted to the slide at a first rod end and being pivoted to the tray at a second rod end.

* * * * *